US005267622A

United States Patent [19]

Fletcher et al.

[11] Patent Number: 5,267,622

[45] Date of Patent: Dec. 7, 1993

[54] IMPACT BLOCK ASSEMBLY FOR PERCUSSION DRILLING APPARATUS

[76] Inventors: Gerald L. Fletcher; Gregory T. Fletcher, both of P.O. Box 4978 JKTM, Jakarta 12049, Indonesia

[21] Appl. No.: 902,090

[22] Filed: Jun. 22, 1992

[51] Int. Cl.[5] ..... F21B 4/06; F21B 4/14

[52] U.S. Cl. ..... 175/296; 175/14; 175/93; 175/414

[58] Field of Search ..... 299/69, 70, 94; 175/14, 175/93, 95, 96, 106, 296, 414

[56] References Cited

U.S. PATENT DOCUMENTS

| | | | |
|---|---|---|---|
| 2,400,853 | 5/1946 | Stilley | 175/414 X |
| 4,883,133 | 11/1989 | Fletcher et al. | 175/93 |
| 5,088,568 | 2/1992 | Simuni | 175/296 X |

*Primary Examiner*—David J. Bagnell
*Attorney, Agent, or Firm*—John E. Reilly

[57] ABSTRACT

In a percussion drilling apparatus, an impact block assembly is provided for sequentially driving drill rods into a subterranean formation, the impact block assembly including an impact block member aligned with one or more rows of drill rods and a combustion operated piston is arranged above the impact block assembly for sequentially driving each of the impact members downwardly into engagement with the aligned drill rods.

17 Claims, 4 Drawing Sheets

IMPACT BLOCK ASSEMBLY FOR PERCUSSION DRILLING APPARATUS

This invention relates to earth boring; and more particularly relates to a percussion drilling apparatus containing a novel and improved impact block assembly.

BACKGROUND AND FIELD OF THE INVENTION

Percussion drilling apparatus has been previously devised for downhole drilling operations and, for example, reference is made to U.S. Pat. No. 4,883,133 for Combustion Operated Drilling Apparatus granted to the applicants of this invention. According to our prior patent, concentric rows of drill rods having impact teeth at the lower ends of the rods are driven sequentially into the earth by firing a series of concentric combustion chambers above the drill rods and which requires closely controlled sequential firing of each combustion chamber to drive an individual piston or impact member downwardly into engagement with the drill rods.

In accordance with the present invention, it is proposed to employ a single combustion chamber with associated drive member or piston to sequentially drive the drill rods into the earth through a novel and improved form of impact block assembly which is interposed between the drive member and drill rods. This approach obviates close timing and control over a series of combustion chambers and shifts the sequential control over advancement of the drill rods to a separate impact block assembly.

SUMMARY OF THE INVENTION

Accordingly, it is an object of this invention to provide for a novel and improved impact block assembly specifically adaptable for use in percussion drilling, such as, for boring earth, rock or hard substances in a dependable and efficient manner.

It is another object of the present invention to provide in a percussion drilling apparatus for a novel and improved impact block assembly to translate the percussive force of a single driving member into sequential driving of a series of impact elements into the earth; and further wherein concentric rings of driving elements are so constructed and arranged as to be sequentially driven to progressively chip off portions of a substance to be penetrated in the earth.

It is a further object of the present invention to provide a percussion drilling apparatus characterized by incorporating a minimum number of driving elements to sequentially advance a series of impact teeth into the earth in downhole drilling operations and wherein the entire system is rugged, durable and highly economical to use.

In accordance with the present invention, there is provided in a percussion drilling apparatus for downhole drilling in which a plurality of drill rods having impact teeth at their lower ends project outwardly from the interior of a housing at the bottom of a drill string or wireline, the drill rods arranged in concentric rows for axially directed reciprocal movement, the improvement comprising impact block means disposed in the drill housing above the drill rods, the impact block means including at least one impact block member aligned with each row of drill rods for reciprocal movement into and from engagement with the drill rods in that row, and drive means above the impact block means for sequentially driving each of the impact block members downwardly into engagement with the aligned drill rods in each row whereby to cause each of the aligned drill rods to sequentially penetrate into the formation. Preferably, the impact block means comprise an upper rotatable series of impact block members and lower non-rotatable impact block members to impart the driving force of the drive means to each aligned row in succession, and cam members are interposed between the upper and lower impact block members for sequentially advancing each of the lower impact block members downwardly against an aligned row of drill rods.

The above and other objects, advantages and features of the present invention will become more readily appreciated and understood from a consideration of the following detailed description when taken together with the accompanying drawings in which:

DETAILED DESCRIPTION OF THE PREFERRED EMBODIMENT

Figure 1:
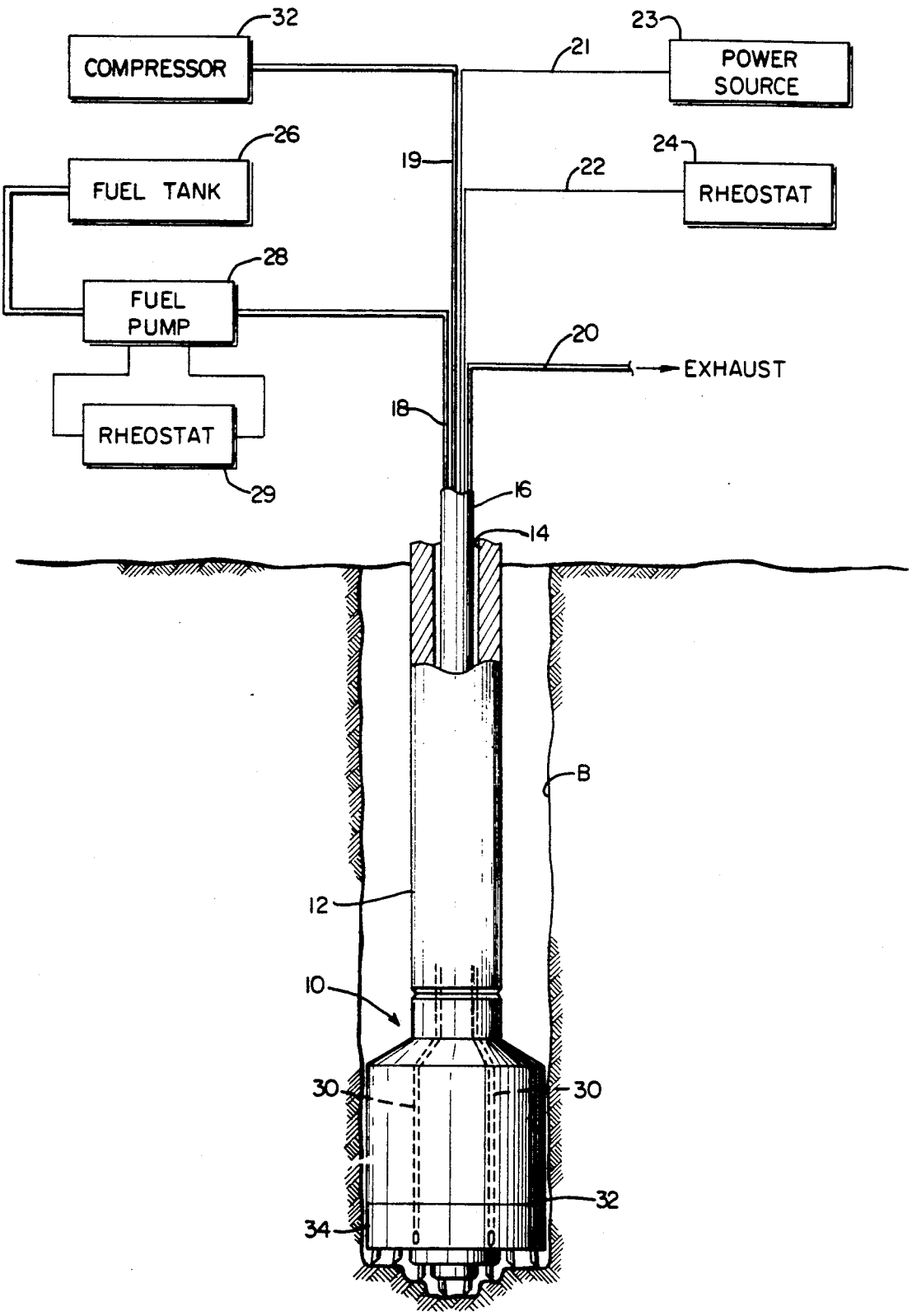
FIG. 1 is a view partially in section of a preferred form of impact block assembly in accordance with the present invention and representing suitable controls utilized at the surface for operation of the assembly.

Referring in more detail to the drawings, FIG. 1 illustrates a preferred form of percussion drilling apparatus 10 mounted at the lower end of a drill string 12 for forming a bore B in a subterranean earth formation. A cable 16 extends downwardly through the hollow interior 14 of the drill string and which cable 16 houses a fuel line 18, a drilling fluid conduit 19, exhaust line 20 and electrical lines 21 and 22 leading respectively from a power source 23 and rheostat 24. The fuel line 18 delivers a combustible fuel/air mixture from a fuel tank 26 and fuel pump 28 regulated by rheostat 29 for delivery of a regulated amount of fuel mixture to the drilling apparatus in a manner to be described. A compressor 32 is employed to pump drilling fluid downwardly through the line 19 through a series of drilling fluid conduits 30 in outer wall 32 of a cylindrical housing 34 of the drilling apparatus 10.

Figure 2:
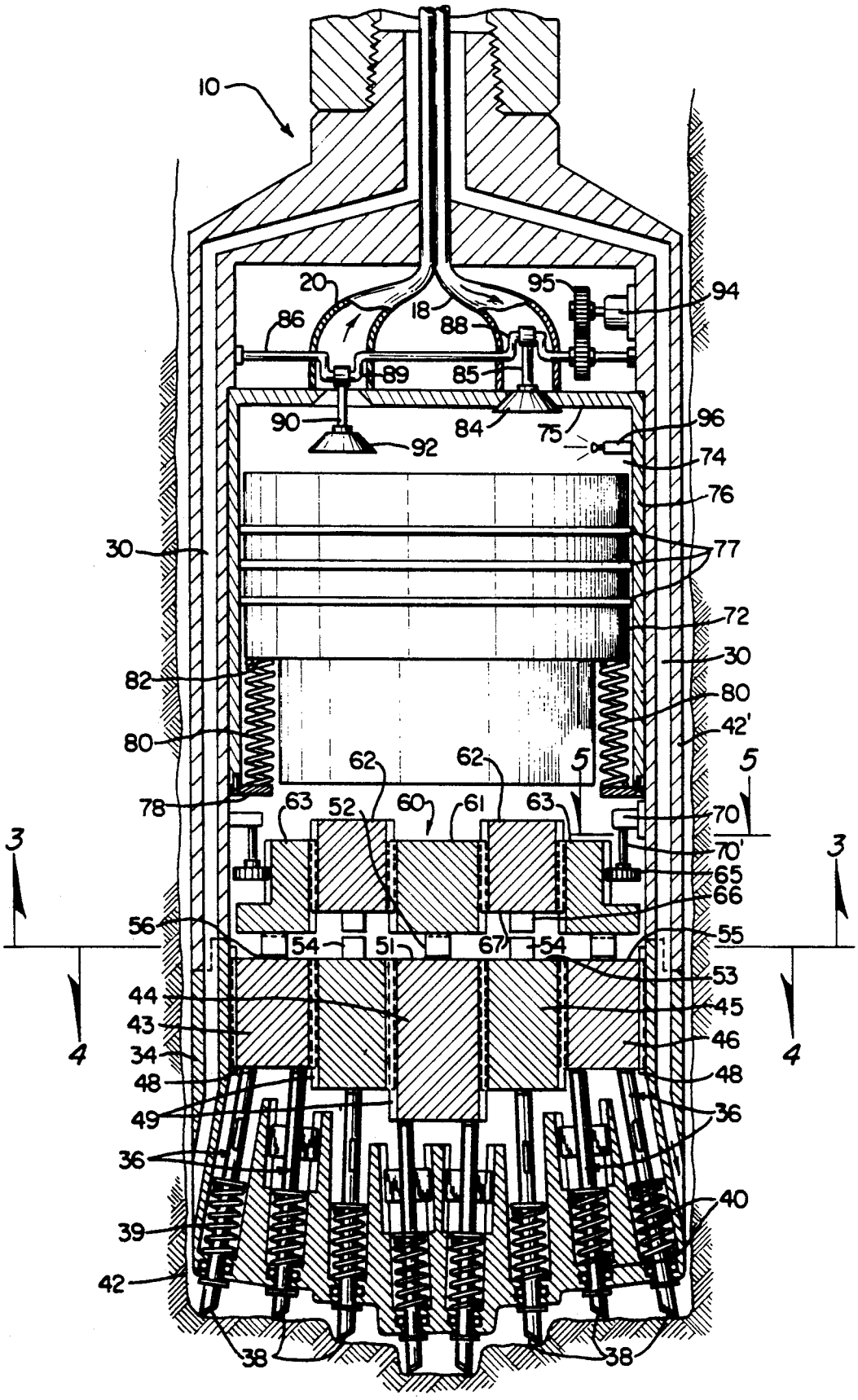
FIG. 2 is an enlarged sectional view of the preferred form of impact block assembly shown in FIG. 1.

Referring to FIG. 2, the apparatus 10 includes a series of drill rods 36 arranged in concentric rows at the lower end of the housing 34. In a manner described in more detail in our hereinbefore referred to U.S. Pat. No. 4,883,133, each of the drill rods 36 includes an impact tooth 38 at its lower end, a return spring 39 mounted on an individual shaft 40 and extending through a bore in a support block 42 so that the lower impact teeth 38 project at different selected angles away from the lower end of the housing and are staggered downwardly toward the center of the housing so as to be normally disposed at different levels and penetrate to progressively increased depths toward the center of the housing when driven into the earth.

Figure 4:
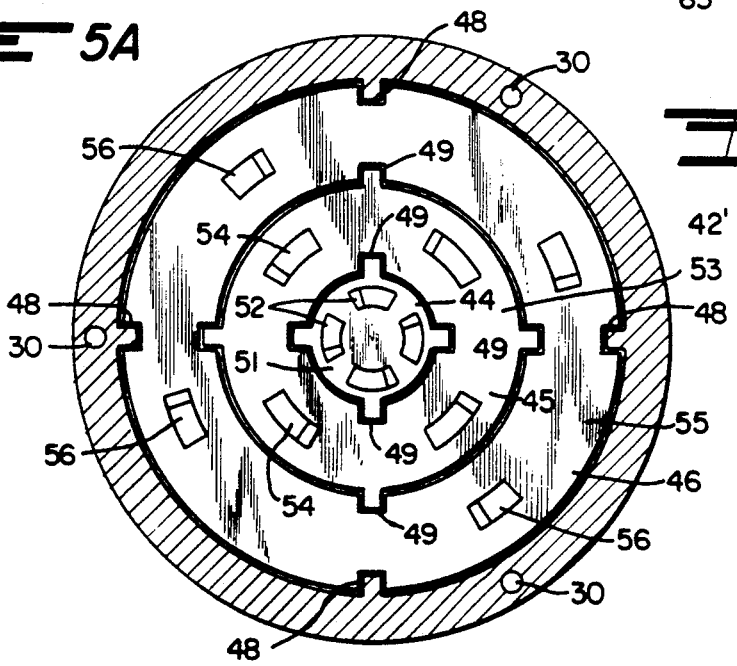
FIG. 4 is a cross-sectional view taken about lines 4—4 of FIG. 2.

A lower impact block assembly 43 is mounted for reciprocal movement above the drill rods 36 and includes a central block member 44, outer concentric annular rings 45 and 46, and the assembly 43 is centered with respect to the housing and fixed against rotation by diametrically opposed splines 48 in longitudinal grooves in the external surface of the outer ring 46, as further illustrated in FIG. 4. In a corresponding manner, interengaging splines 49 fit in grooves which are provided between the center block 44 and annular rings 45 and 46 to fix the entire block assembly 43 against rotation while permitting the block 44 and rings 45 and 46 to axially reciprocate independently of one another.

The center block 44 is axially aligned with respect to the center or innermost drill rods 36, and the block 44 is of elongated cylindrical configuration, being the longest of the block members 44 to 46, and including a flat upper surface 51 having upwardly projecting ramps 52 at equally spaced circumferential intervals. The middle ring 45 is of annular configuration and aligned with the drill rods 36 just outwardly of the innermost drill rods. Accordingly, the length of the ring 45 is less than that of the center block 44 and has a flat upper surface 53 with a plurality of ramps 54 at equally spaced circumferential intervals but offset in a circumferential direction with respect to the ramps 52 of the center block. The outer ring 46 is the shortest of the impact block members and aligned axially with respect to the outer two rows of drill rods 36. The outer ring is similarly provided with a flat upper surface 55 and ramps 56, the latter being circumferentially offset with respect to the ramps 52 and 54. As best seen from FIGS. 3 and 4, each of the ramps 52, 54 and 56 includes an inclined surface portion 57 terminating in an upper flat surface portion 58.

Figure 3:
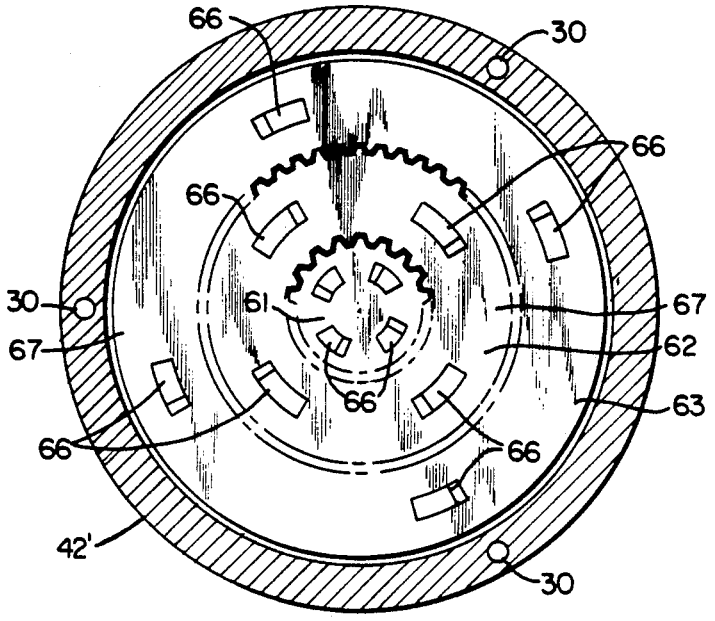
FIG. 3 is a cross-sectional view taken about lines 3—3 of FIG. 2.
Figure 6:
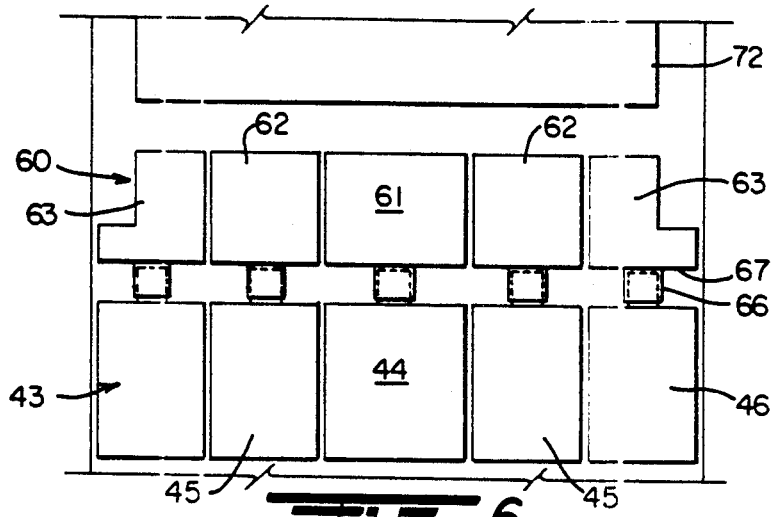
FIG. 6 is a somewhat schematic view illustrating the relationship between impact block members in a neutral position.
Figure 7:
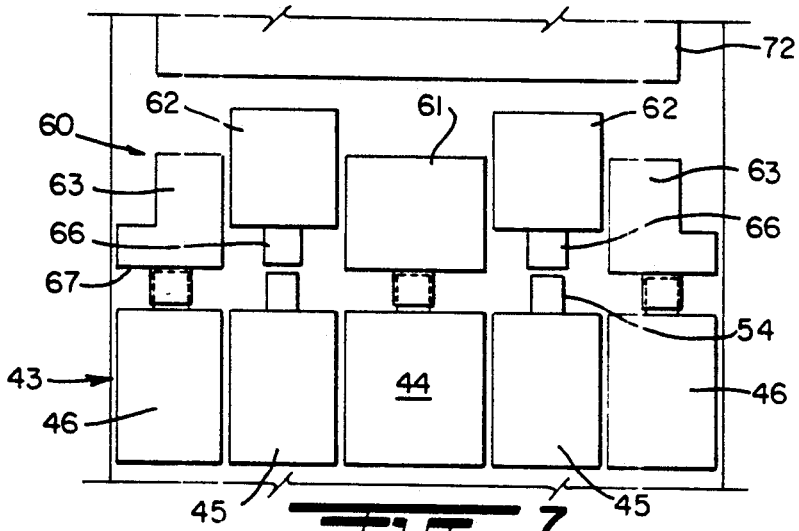
FIG. 7 is another schematic view of the impact block members illustrated in FIG. 2 with intermediate impact ring members in a firing position.
Figure 8:
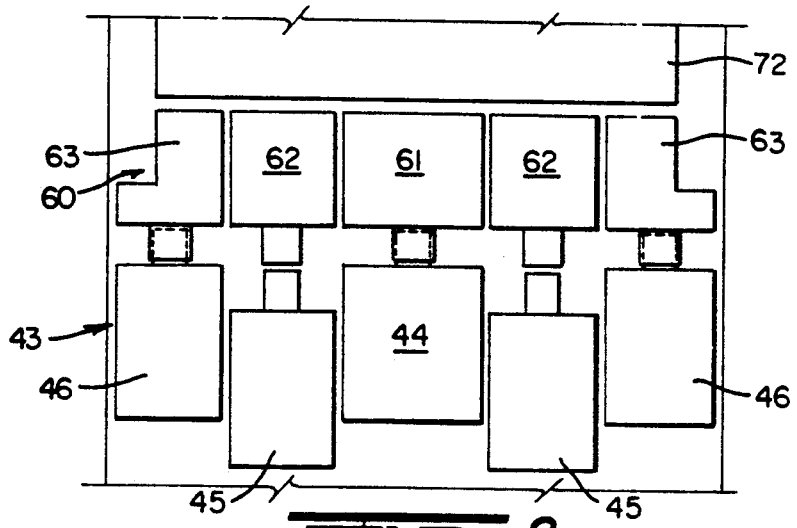
FIG. 8 is another schematic view of the impact block member shown in FIGS. 6 and 7 after the intermediate ring member has been fired.

Referring to FIGS. 2 and 3, an upper impact block assembly 60 is comprised of a center block 61 and outer concentric rings 62 and 63 which are disposed for reciprocal movement above and aligned with the respective blocks 44, 45 and 46. Each of the blocks 61 to 63 is provided with axially directed teeth 64 on their external surfaces in intermeshing relation to one another so that rotation of the outer block 63 is imparted to the block 62 and in turn to the block 61 under the control of a pinion gear 65 which is supported for rotation on an inner spaced wall 42' within the housing 42. Each of the blocks 61, 62 and 63 is of a corresponding length and provided with ramps 66 at equally spaced circumferential intervals along bottom surfaces 67 of each block. The ramps 66 are offset in a corresponding manner to those described with reference to the lower impact block assembly so that the ramps 66 on each of the blocks 61-63 will simultaneously engage the ramps of an aligned one of the block members 44-46 of the lower block assembly 43. Thus, as the upper block assembly 60 is rotated through one revolution, the ramps 66 will successively move into engagement with the aligned ramps on each successive lower impact block member, such as, in the manner illustrated in FIGS. 6 to 8. For example, when ramps 66 of the intermediate block 62 are rotated into engagement with the ramps 54 of the lower impact block 45, the block 62 will be lifted above the blocks 61 and 63 as illustrated in FIG. 7. Preferably, an electric drive motor 70 has its output shaft 70' drivingly connected to the pinion gear 65 to impart rotation to the upper impact block assembly 60 as described and is controlled through the power source 23 to drive the blocks 61-63 through positions causing the ramps of each respective block to be aligned with the ramps of the lower impact block, at which point the raised block is driven downwardly to force the associated lower impact block member downwardly into engagement with the aligned row of drill rods.

The driving or percussive force for the impact block assemblies 43 and 60 is supplied by a piston head 72 which is suspended at the lower end of combustion chamber 74. The combustion chamber 74 is of generally inverted cup-shaped configuration including a top wall 75 and outer cylindrical wall 76 with piston rings 77 interposed between the wall 76 and piston head 72 to establish sealed engagement between the piston head 72 and chamber wall 76 and at the same time permitting axially slidable movement of the piston head 72. An annular lip 78 serves as a limit stop for movement of the piston head 72 at the lower open end of the combustion chamber and a series of return springs 80 are arranged at equally spaced circumferential intervals around the lower end of the chamber wall 76 and seated against the limit stop 78 to suspend the piston head 72 in spaced relation to the upper impact block assembly 60. The return springs 80 bear against a circumferential shoulder 82 at the lower end of the piston head.

The piston head is activated by delivery of a fuel air mixture via the fuel conduit 18 through a port in the upper wall 75, the port being opened and closed by a fuel injection valve 84 which is mounted on an articulated valve stem 85 for downward extension from a crankshaft 86. The crankshaft 86 extends diametrically across the upper end of the drill housing of the combustion chamber and includes an off-center crank portion 88 to which the valve stem 85 is secured and another offset or crank 89 to which an articulated valve stem 90 for exhaust valve 92 is secured, the exhaust valve 92 serving to open and close a port in the upper wall 75 which is in communication with the exhaust conduit 20. The crankshaft is operated by an electric motor representated at 94 and which through suitable speed reduction gearing 95 rotates the crankshaft to alternately open and close the fuel injection and exhaust ports. As the fuel/air mixture is introduced into the combustion chamber above the piston head an electric firing mechanism or ignitor 96 is timed with the introduction of the mixture to ignite the fuel/air mixture to drive the piston head downwardly against the raised impact block member of the assembly 60 as previously described. Ignition of the fuel/air mixture is timed with the opening of the fuel injection valve and raising of each of the impact blocks 61-63 during each revolution of the assembly 60 thereby driving each concentric row of drill rods 36 in succession downwardly into the earth. The rotating mechanism for the upper assembly 60 is similarly coordinated so as to impart rotation to the assembly at a rate necessary to raise each of the impact blocks into position long enough for the piston head to be driven downwardly into engagement with the raised block. When the exhaust valve 92 opens the port following combustion of the fuel/air mixture, the spent gases are discharged through the exhaust valve port and exhaust conduit 20. As the pressure is reduced in the combustion chamber, the return springs 80 will cause the piston head 72 to be raised to its original position in preparation for the next firing. Simultaneously, the return springs 39 on the drill rods 36 will overcome the upper and lower impact blocks which have been driven downwardly by the piston to return those blocks to their original positions. Rotation of the upper impact block assembly 60 continues until the next impact block is raised by the ramps into position to be in the path of travel of the piston for driving the next row or rows of drill rods downwardly as described.

Figure 5A:
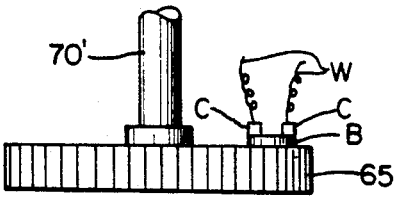
FIG. 5A is an enlarged view of the drive gear for the upper impact block assembly.
Figure 5:
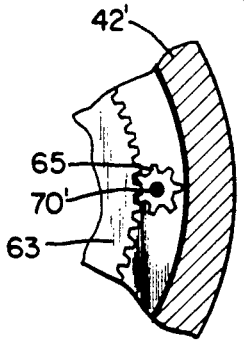
FIG. 5 is a cross-sectional view taken about lines 5—5 of FIG. 2.

Any suitable means may be employed to synchronize or time the ignition of the fuel/air mixture with the lifting or raising of each respective impact block member of the assembly 60. The necessary synchronization between firing of the piston head and rotation of the upper impact block assembly 60 can be achieved through the use of electrical contacts C on the pinion 65 for the upper impact block assembly 60 and which contacts C engage a block B on the pinion to complete the circuit through the wiring W to the firing mechanism 96 at spaced intervals coordinated with the movement of each impact ring into the raised position so that the piston can be fired several times each revolution, bearing in mind that the impact block assembly is rotating slowly enough that the downward force of the piston will not interfere with its rotation. As shown in FIG. 5A, in the alternative, the drive motor 70 can be deactivated to temporarily halt rotation of the upper block assembly 60 synchronously with ignition of the firing mechanism 96; or the same could be accomplished by removal of teeth on the pinion 65 at those points which coincide with the downward movement of the piston head 72.

From the foregoing, it will be evident that various modifications and changes may be made in the precise number of drill rods, impact blocks or rings used in association with the drill rods and the motive power or drive source used to generate a percussive force necessary to drive the impact teeth under a great deal of force into the earth. Of course, the number and size of drill rods will vary substantially according to the size of bore hole to be drilled and the nature of the formation.

It is therefore to be understood that the above and other modifications and changes may be made in the preferred form of percussion drilling apparatus as herein set forth and described without departing from the spirit and scope of the invention as defined by the appended claims.

I claim:

1. In a percussion drilling apparatus for drilling into subterranean earth formations wherein a plurality of drill rods having impact teeth at their lower ends project downwardly from the interior of a housing at the bottom of a drill string, said drill rods arranged in concentric rows for axially directed reciprocal movement, the improvement comprising:

impact block means disposed in said housing above said drill rods, said block means including an impact ring member aligned with each of said drill rows for reciprocal movement into and away from engagement with said drill rows; and drive means above said impact block means for sequentially driving each of said impact ring members downwardly into engagement with said aligned drill row whereby to cause each of said aligned drill rows to sequentially penetrate said formation.

2. In percussion drilling apparatus according to claim 1, said impact block means including upper and lower impact ring members.

3. In percussion drilling apparatus according to claim 2, including means for rotating said upper impact ring members with respect to said lower impact ring members, and cam means interposed between said upper and lower impact ring members for sequentially advancing each of said upper impact ring members upwardly for engagement with said drive means.

4. In percussion drilling apparatus according to claim 3, said drive means including a piston member mounted for reciprocal movement above said impact block means, and means for imparting a downward percussive force to said piston member causing said piston member to advance into engagement with said impact block means.

5. In percussion drilling apparatus according to claim 1, including means for returning each of said aligned rows of drill rows upwardly after penetrating said formation.

6. In percussion drilling apparatus according to claim 1, said drive means including a combustion chamber and a piston member mounted for reciprocal movement in said combustion chamber above said impact block means.

7. In percussion drilling apparatus according to claim 6, said drive means including means for introducing a fuel/air mixture into said combustion chamber, ignition means in said combustion chamber for igniting said fuel/air chamber to impart a downward percussive force to said piston member, and return means for returning said piston member to a raised position after being driven downwardly into engagement with said impact block means.

8. In percussion drilling apparatus according to claim 7, said impact block means including upper and lower impact ring members, means for rotating said upper impact ring members with respect to said lower impact ring members, and cam means interposed between said upper and lower impact ring members for sequentially advancing each of said upper impact ring members into the path of travel of said piston member.

9. In percussion drilling apparatus according to claim 8, including means for coordinating a sequential advancement of said upper impact ring members with the ignition of said fuel/air mixture in said combustion chamber.

10. In a percussion drilling apparatus for drilling bores into subterranean earth formations wherein a plurality of drill rods having impact teeth at their lower ends project downwardly from the interior of a housing at the bottom of a drill string, said drill rods arranged in concentric rows for axially directed reciprocal movement, the improvement comprising:

impact block means disposed in said housing above said drill rods, said block means including an impact ring member aligned with each of said drill rows for reciprocal movement into and away from engagement with said drill rows;

drive means above said impact block means for sequentially driving each of said impact ring members downwardly into engagement with said aligned drill row whereby to cause each of said aligned drill rows to sequentially penetrate said formation; and means for returning each of said aligned rows of drill rows upwardly after penetrating said formation.

11. In percussion drilling apparatus according to claim 10, said drive means including a combustion chamber and a piston member mounted for reciprocal movement in said combustion chamber above said impact block means.

12. In percussion drilling apparatus according to claim 11, said drive means including means for introducing a fuel/air mixture into said combustion chamber, ignition means in said combustion chamber for igniting said fuel/air chamber to impart a downward percussive force to said piston member, and return means for returning said piston member to a raised position after being driven downwardly into engagement with said impact block means.

13. In percussion drilling apparatus according to claim 12, said impact block means including upper and lower impact ring members, means for rotating said upper impact ring members with respect to said lower impact ring members, and cam means interposed between said upper and lower impact ring members for sequentially advancing each of said upper impact ring members into the path of travel of said piston member.

14. In percussion drilling apparatus according to claim 13, including means for coordinating a sequential advancement of said upper impact ring members with the ignition of said fuel/air mixture in said combustion chamber.

15. In percussion drilling apparatus according to claim 10, said drive means including a piston member mounted for reciprocal movement above said impact block means, and means for imparting a downward percussive force to said piston member into engagement with said impact block means.

16. In percussion drilling apparatus according to claim 10, said impact block means including upper and lower impact ring members.

17. In percussion drilling apparatus according to claim 16, including means for rotating said upper impact ring members with respect to said lower impact ring members, and cam means interposed between said upper and lower impact ring members for sequentially advancing each of said upper impact ring members upwardly for engagement with said drive means.

* * * * *